US006619208B2

(12) United States Patent
Ono et al.

(10) Patent No.: US 6,619,208 B2
(45) Date of Patent: Sep. 16, 2003

(54) CONVEYING DEVICE USING SUCTION ADHERENCE FOR PRINTING PLATES

(75) Inventors: Tsukasa Ono, Kanagawa (JP); Takashi Koizumi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 124 days.

(21) Appl. No.: 09/775,592

(22) Filed: Feb. 5, 2001

(65) Prior Publication Data

US 2001/0011513 A1 Aug. 9, 2001

(30) Foreign Application Priority Data

Feb. 3, 2000 (JP) ..... 2000-026348

(51) Int. Cl.[7] ..... B41F 27/00
(52) U.S. Cl. ..... 101/477; 101/389.1
(58) Field of Search ..... 101/232, 382.1, 101/389.1, 477, 484, DIG. 36; 271/10.05, 10.07, 10.03, 12, 31, 94, 96

(56) References Cited

U.S. PATENT DOCUMENTS 3,774,192 A * 11/1973 Boulter ..... 307/116
5,617,338 A * 4/1997 Sugano et al. ..... 702/140
5,788,425 A * 8/1998 Skow et al. ..... 406/88
6,112,663 A * 9/2000 Ulrich et al. ..... 101/389.1
6,186,491 B1 * 2/2001 Tomiyama et al. ..... 271/12
6,536,344 B2 * 3/2003 Kawamura et al. ..... 101/477

FOREIGN PATENT DOCUMENTS

JP 11-11726 A 1/1999

* cited by examiner

*Primary Examiner*—Ren Yan
(74) *Attorney, Agent, or Firm*—Sughrue Mion, PLLC

(57) ABSTRACT

A pressure switch 302 is set in communication with suction cups 124 of a suction adherence conveying device 109 applied to an automatic exposure device. Further, a suction fan 126, which can approach and move away from a photopolymer plate 102 or an interleaf sheet 118 accommodated within a magazine 208, is set integrally with the suction cups 124. By utilizing the fact that degrees of vacuum of the suction cups 124 differ in accordance with materials to be suction-adhered, determination of a material to be suction-adhered is performed based on output signals of the pressure switch 302.

24 Claims, 15 Drawing Sheets

CONVEYING DEVICE USING SUCTION ADHERENCE FOR PRINTING PLATES

BACKGROUND OF THE INVENTION

1. Field of the Invention

The present invention relates to a suction adherence conveying device for printing plates in which a printing plate or an interleaf sheet accommodated in a magazine is suction-adhered by suction cups and taken out one sheet at a time from the magazine in that state.

2. Description of the Related Art

A technique (an automatic exposure device for printing plates) has been developed in which a printing plate (which will be referred to as a photopolymer plate, hereinafter) in which a photosensitive layer (for example, a photopolymerization layer) is provided on a support is used and an image is directly recorded on the photopolymerization layer of the photopolymer plate by a laser beam or the like.

In the technique described above, recording of images onto photopolymer plates is performed rapidly, and thus, it is required to feed photopolymer plates continuously. As a result, a plurality of photopolymer plates and interleaf sheets for protecting the plate surfaces of the photopolymer plates are accommodated in a magazine in a state in which they are stacked alternately, and stand-by in this state at a predetermined position, and are suction adhered by a suction section comprised of suction cups and a fan. The plurality of photopolymer plates and interleaf sheets are thereby automatically taken out one sheet at a time, and only the photopolymer plates are fed to an exposure section.

Accordingly, when a photopolymer plate or an interleaf sheet accommodated in the magazine in the stacked state are taken out, they are differentiated on the basis of predetermined differentiation signals. Based on the results of determination as to whether a photopolymer plate or an interleaf sheet has been removed, a portion of a conveying path is switched such that only the photopolymer plates are conveyed to the exposure section, and the interleaf sheets are conveyed to an interleaf sheet stacking device.

In the above-described conventional suction adherence conveying device for printing plates, for example, the photopolymer plates and the interleaf sheet are differentiated by a difference in reflectances of the photopolymer plates and the interleaf sheets by using a photoswitch.

However, photoswitches are expensive, and there is the concern that photopolymer plates which have not yet been exposed may be sensitized by light of the photoswitch.

SUMMARY OF THE INVENTION

In view of the aforementioned, an object of the present invention is to provide a suction adherence conveying device for printing plates which is low-cost and can distinguish between printing plates and interleaf sheets taken out from a magazine without sensitizing the unexposed printing plates.

A first aspect of the present invention is a suction adherence conveying device for printing plates comprising: suction cups which are provided so as to be able to approach and move away from a surface of a printing plate or an interleaf sheet accommodated in a magazine; a suction section which is communicated with the suction cups through communicating paths and sucks in air from the suction cups, and due to the suction section sucking in air from the suction cups, the printing plate or the interleaf sheet is vacuum-suction-adhered and removed from the magazine in this state one at a time; and a pressure sensor which is set in communication with the communication paths, and detects that a degree of vacuum at the time of suction-adhesion by the suction cups is greater than or equal to a first degree of vacuum set to correspond to a case in which the interleaf sheet is suction-adhered, and detects that the degree of vacuum at the time of suction-adhesion by the suction cups is greater than or equal to a second degree of vacuum which is set to correspond to a case in which the printing plate is suction-adhered and which is higher than the first degree of vacuum.

Here, the first and second predetermined degrees of vacuum are set based on the capacity of the suction section and the air permeability between the suction cups and the material to be suction-absorbed (the printing plate or the interleaf sheet).

Further, the pressure sensor of the suction adherence conveying device of the first aspect of the present invention may be a pressure sensor which outputs signals which are linear with respect to the degree of vacuum. Or, the pressure sensor may be two or more pressure switches which each output a predetermined signal (such as a signal turning a contact ON/OFF) when the degree of vacuum is greater than or equal to a predetermined degrees of vacuum. Alternatively, the pressure sensor may be a single pressure switch which has two or more set vacuum degrees and outputs different signals (such as a signal turning a contact ON/OFF and combinations thereof when the degree of vacuum is greater than or equal to the set degrees of vacuum.

In the suction adherence conveying device for printing plates of the first aspect of the present invention, in a case in which the suction cups suction-adhere an interleaf sheet, the pressure sensor detects the fact that the degree of vacuum at the time of suction adherence by the suction cups is greater than or equal to the first predetermined degree of vacuum. On the other hand, in a case in which the suction cups suction-adhere a printing plate, the pressure sensor detects the fact that the degree of vacuum at the time of suction adherence by the suction cups is greater than or equal to the second predetermined degree of vacuum.

Accordingly, it can be determined whether the suction adhered material is a printing plate or an interleaf sheet on the basis of the detection signals of the pressure sensor. Moreover, in a case in which the pressure sensor does not output signals in accordance with respective states described above, it is determined that the suction cups are not suction-adhering any material.

As described above, an inexpensive pressure sensor can be used in order to distinguish between a photopolymer plate and an interleaf sheet taken out from a magazine. Therefore, a reduction in costs can be achieved, and there is no fear of sensitizing printing plates which have not been exposed.

Preferably, the suction adherence conveying device for printing plates of the present invention includes a suction fan which can, along with the suction cups, approach and move away from the surface of the printing plate or the interleaf sheet accommodated in the magazine, and which has a suction-adherence capacity capable of suction-adhering an interleaf sheet and incapable of suction-adhering a printing plate from a position which is spaced a predetermined distance apart from the surface of the printing plate or the interleaf sheet.

Preferably, the suction adherence conveying device of the present invention activates the suction fan at the position where the suction cups are spaced apart by a predetermined distance from the surface of the printing plate or the interleaf sheet. Thus, in a case in which the uppermost material among the materials stacked in a magazine is an interleaf sheet, the interleaf sheet can be sucked by the suction cups in a state in which only the interleaf sheet is sucked by the suction fan and the interleaf sheet and the printing plate are apart from each other.

Therefore, even in a case in which the printing plate is curled, the problem of incorrect determination at the time of sucking an interleaf sheet which is caused by the suction cups being too close to the interleaf sheet, and the problem of suction-adherence of two layers in which the photopolymer plate stacked beneath the interleaf sheet is sucked up together with the interleaf sheet are prevented, and an improvement in reliability can be achieved.

A second aspect of the present invention is a conveying device using suction adherence for separating different types of sheets of materials from one another, the conveying device comprising: (a) a magazine adapted for receiving different types of sheets of materials interleaved with another in a stack in the magazine; (b) a support structure to which the magazine removably mounts; (c) a plurality of suction cups movably mounted to the support structure, the suction cups being movable in a direction towards and away from a stack of sheet materials in the magazine; (d) a vacuum system connected through fluid communication paths to the suction cups, and a reduced pressure communicated to the suction cups through the communication paths when the vacuum system is operated and generating a suction at the suction cups, which suction adheres a sheet of material from the stack when the suction cups are moved proximate the stack; and (e) a pressure sensor in communication with the fluid communication paths, the sensor when operated, producing a signal corresponding to a degree of vacuum in the fluid communication paths for indicating whether a sheet material has adhered to the suction cups, and type of sheet material.

A third aspect of the present invention is a conveying device using suction adherence for separating different types of sheets of materials from one another, the conveying device comprising: (a) a magazine adapted for receiving different types of sheets of materials interleaved with another in a stack in the magazine; (b) a support structure to which the magazine removably mounts; (c) a suction system having a plurality of suction cups with tubes connecting the suction cups in fluid communication with one another, the suction cups being movably mounted to the support structure in a direction towards and away from a stack of sheet materials in the magazine; (d) a suction assisting section provided adjacent the suction cups, which is connected in fluid communication with the suction cups through the tubes; and (e) a pressure switch activated in response to a degree of vacuum at least equal to first and second levels, the first level indicating one type of sheet material has been suction adhered to the suction cups, and the second level indicating another type of sheet material has been suction adhered to the suction cups, the pressure switch outputting a signal when activated in accordance with the level of the degree of vacuum.

A fourth aspect of the present invention is a conveying device using suction adherence for separating different types of sheets of materials from one another, the device comprising: (a) a magazine adapted for receiving different types of sheets of materials interleaved with another in a stack in the magazine; (b) a support structure to which the magazine removably mounts; (c) a plurality of suction cups movably mounted to the support structure, the suction cups being movable in a direction towards and away from a stack of sheet materials in the magazine; (d) a vacuum pump connected through fluid communication paths to the suction cups, and a reduced pressure communicated to the suction cups through the communication paths when the vacuum pump is operated and generating a suction at the suction cups, which suction adheres a sheet of material from the stack when the suction cups are moved proximate the stack; and (e) a pressure switch activated in response to a degree of vacuum at least equal to first and second levels, the first level indicating one type of sheet material has been suction adhered to the suction cups, and the second level indicating another type of sheet material has been suction adhered to the suction cups, the pressure switch outputting a signal when activated in accordance with the level of the degree of vacuum.

A fifth aspect of the present invention is a method for distinguishing different types of sheet material from one another, the method comprising: (a) suction adhering a sheet material to suction cups, using a vacuum system to communicate a reduced pressure to the suction cups through fluid communication paths; (b) detecting the pressure in at least one of the fluid communication paths using a pressure sensor and outputting a signal from the sensor corresponding to detected pressure; and (c) determining the type of sheet material based on the signal.

BRIEF DESCRIPTION OF THE DRAWINGS

FIGS. 12A, 12B and 12C are side views which illustrate operation of a discharge mechanism section, wherein FIG. 12A illustrates a state in which a temporarily supporting arm is in a horizontal position, FIG. 12B illustrates a state in which the temporarily supporting arm is in a withdrawn position, and FIG. 12C illustrates a state in which the temporarily supporting arm is in a raised position.

DESCRIPTION OF THE PREFERRED EMBODIMENTS

Overall Structure

Figure 1:
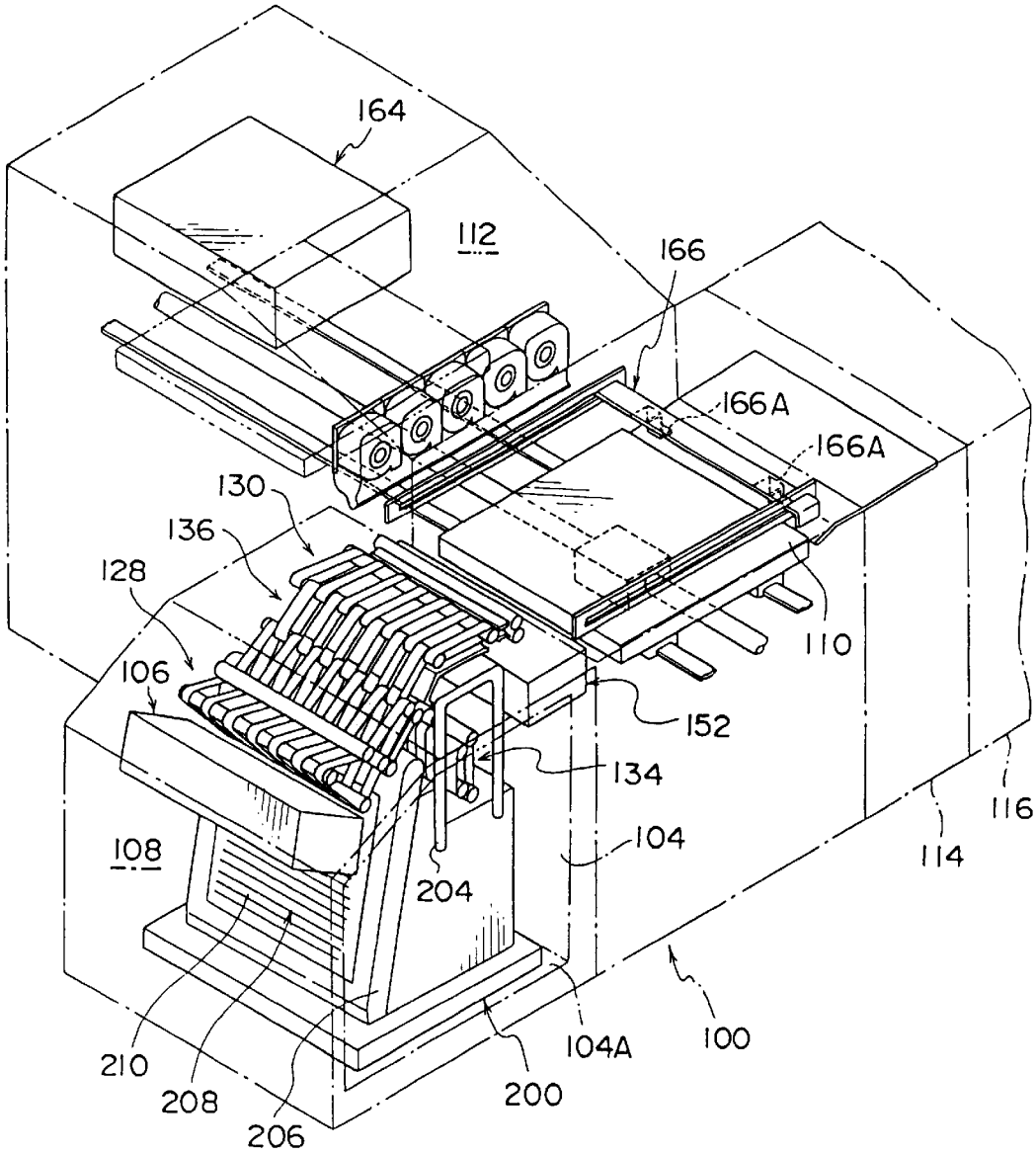
FIG. 1 is a perspective view which illustrates an overall structure of an automatic exposure device relating to an embodiment of the present invention.

FIG. 1 is a perspective view illustrating an overall structure of an automatic exposure device 100 for photopolymer plates to which a suction adherence conveying device 109 relating to an embodiment of the present invention is applied.

The automatic exposure device 100 is formed by: a plate feeding section 108 which includes a plate accommodating section 104, serving as a carriage accommodating section which accommodates photopolymer plates 102 (see FIG. 2) loaded on a carriage 200, and a sheet section 106 which takes out the photopolymer plates 102 accommodated in the plate accommodating section 104; a surface plate 110 on which a photopolymer plate 102 is positioned and held; and an exposure section 112 where an image is recorded onto the photopolymer plate 102 positioned on the surface plate 110.

Further, at a downstream side of this automatic exposure device 100, an automatic developing device 116 may be set via a buffer section 114, such that plate feeding, exposure, and development can all be carried out automatically.

Figure 2:
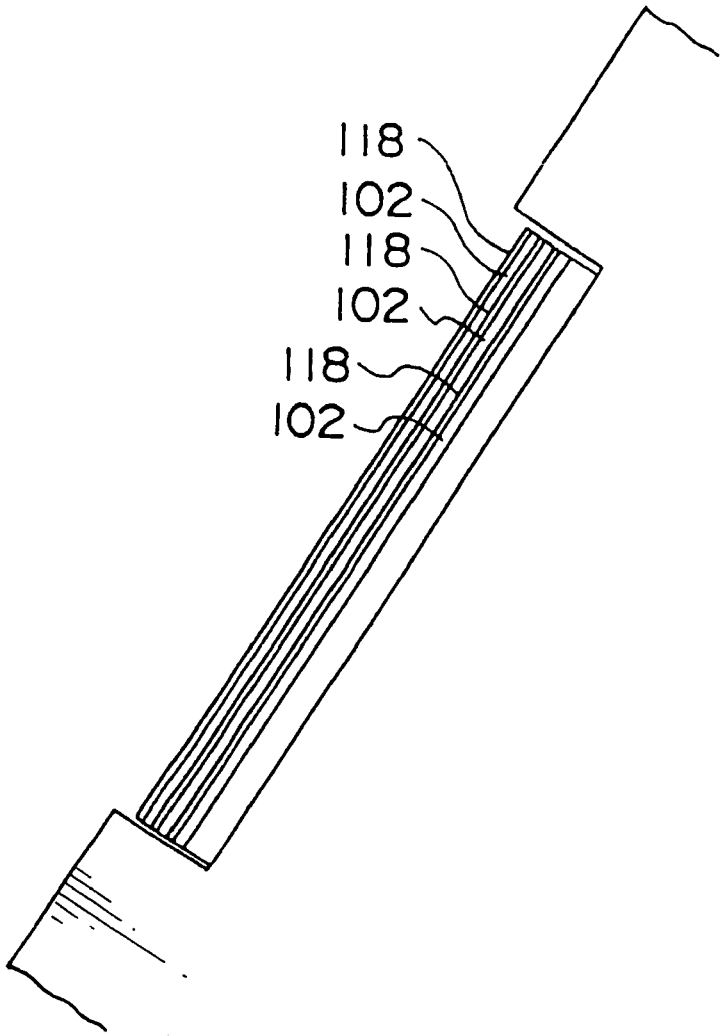
FIG. 2 is a side view which illustrates a state of photopolymer plates and interleaf sheets loaded in a magazine.
Figure 3:
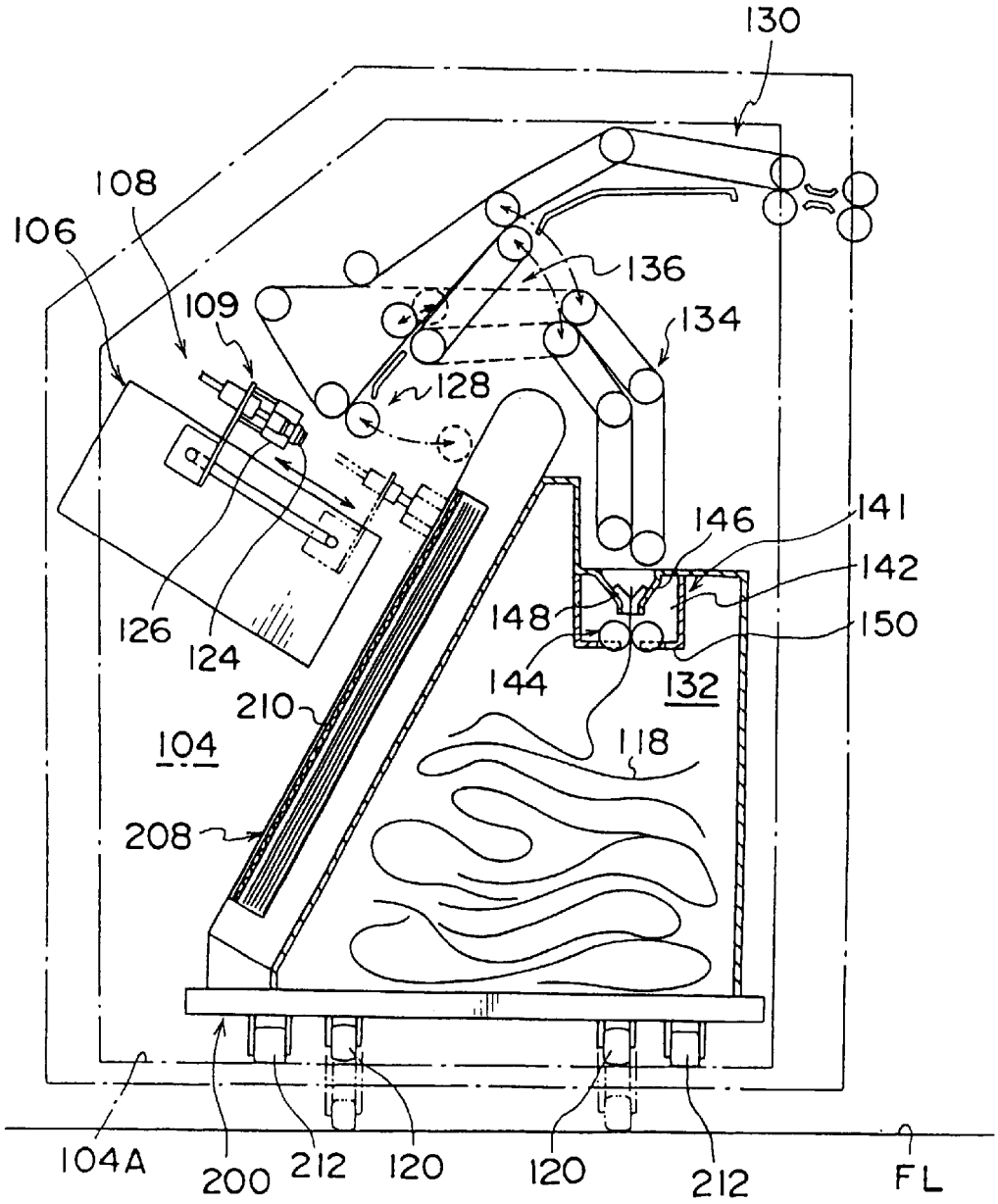
FIG. 3 is a side view of a plate feeding section.

As illustrated in FIG. 3, the carriage 200, on which a magazine 208 which accommodates a plurality of photopolymer plates 102 is provided and which will be described in detail later, can be accommodated in the plate accommodating section 104. As illustrated in FIG. 2, an interleaf sheet 118 serving as a sheet material for protection is provided on the surface of each photopolymer plate 102 accommodated in the magazine 208. As a result, the photopolymer plates 102 and the interleaf sheets 118 are alternately stacked.

The plate accommodating section 104, which accommodates the carriage 200 on which the magazine 208 is provided, is structured such that a floor portion 104A is formed at a position higher than a floor surface and the carriage 200 can be raised up onto this floor portion 104A from the floor surface. In other words, the carriage 200 is supported on the floor surface via casters 120. The casters 120 are movable between protruding positions (positions shown by imaginary lines in FIG. 3) and accommodated positions (positions shown by solid lines in FIG. 3) with respect to the carriage 200.

In accordance with the work for accommodating the carriage 200 into the plate accommodating section 104, when the casters 120 are folded up and moved to their accommodated positions, simultaneously, auxiliary rollers 212 correspond to the floor portion 104A, and thereafter, the carriage 200 is supported on the floor portion 104A via the auxiliary rollers 212.

Above the plate accommodating section 104, the sheet section 106 is provided. At the sheet section 106, the photopolymer plates 102 and the interleaf sheets 118 accommodated in the magazine 208 in a stacked state are taken out alternately by means of the suction adherence conveying device 109 and are sent to the plate feeding section 108. Moreover, the sheet section 106 includes suction cups 124 serving as suction adherence portions which suck the photopolymer plates 102 and the interleaf sheets 118. Further, other than the suction cups 124, a suction fan 126 serving as a suction adherence portion which functions auxiliary when the interleaf sheet 118 is to be sucked is provided in the vicinity of the suction cups 124. The plurality of suction cups 124 and the suction fan 126 are disposed at positions opposing the photopolymer plates 102 and the interleaf sheets 118 along the transverse direction of the photopolymer plates 102 and the interleaf sheets 118.

Figure 4:
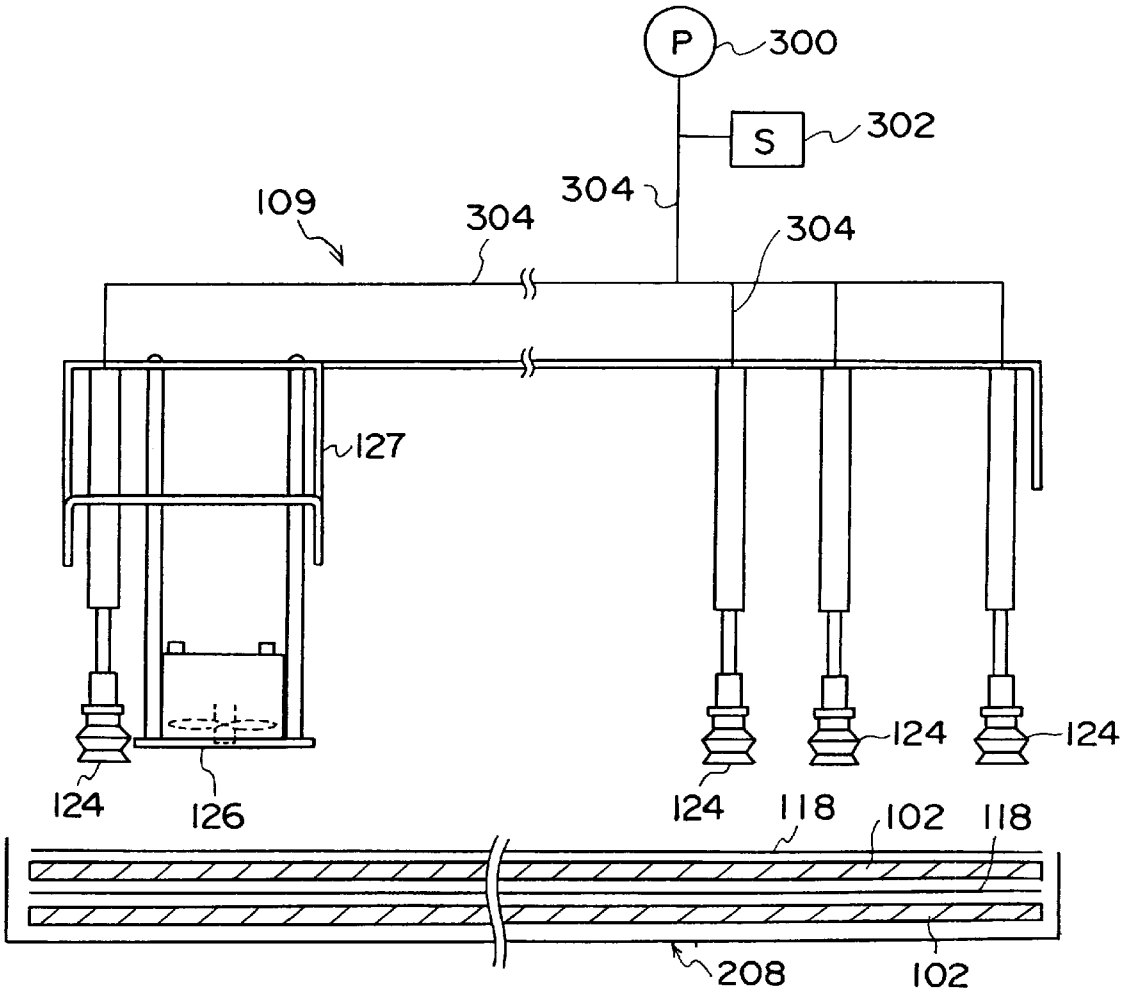
FIG. 4 is a schematic system view which illustrates a communicated state between suction cups, a vacuum pump, and a pressure switch.

As illustrated in FIG. 4, the plurality of suction cups 124 are in communication with each other via tubes 304, and are further communicated with a vacuum pump 300 which draws in air from the suction cups 124. Also, a pressure switch 302 is set in communication with the suction cups 124, on the tube 304 provided at a side of the vacuum pump 300 at which side the tubes 304 communicating with the suction cups 124 are provided.

Figure 5:
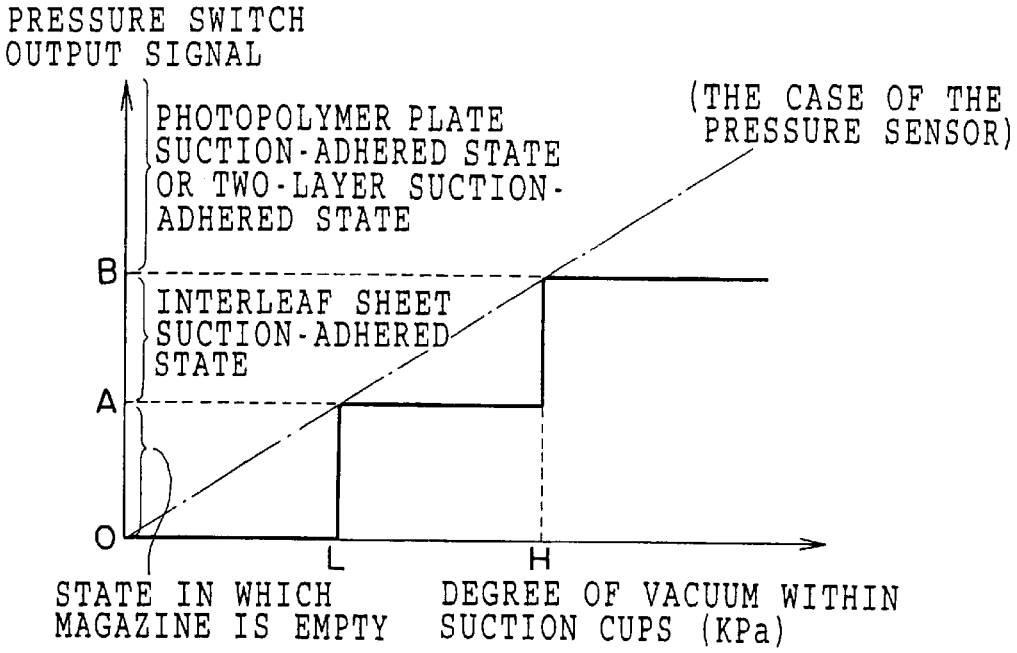
FIG. 5 is a graph which shows the relationship between degree of vacuum within the suction cup and a pressure switch output signal, and determination states.
Figure 6:
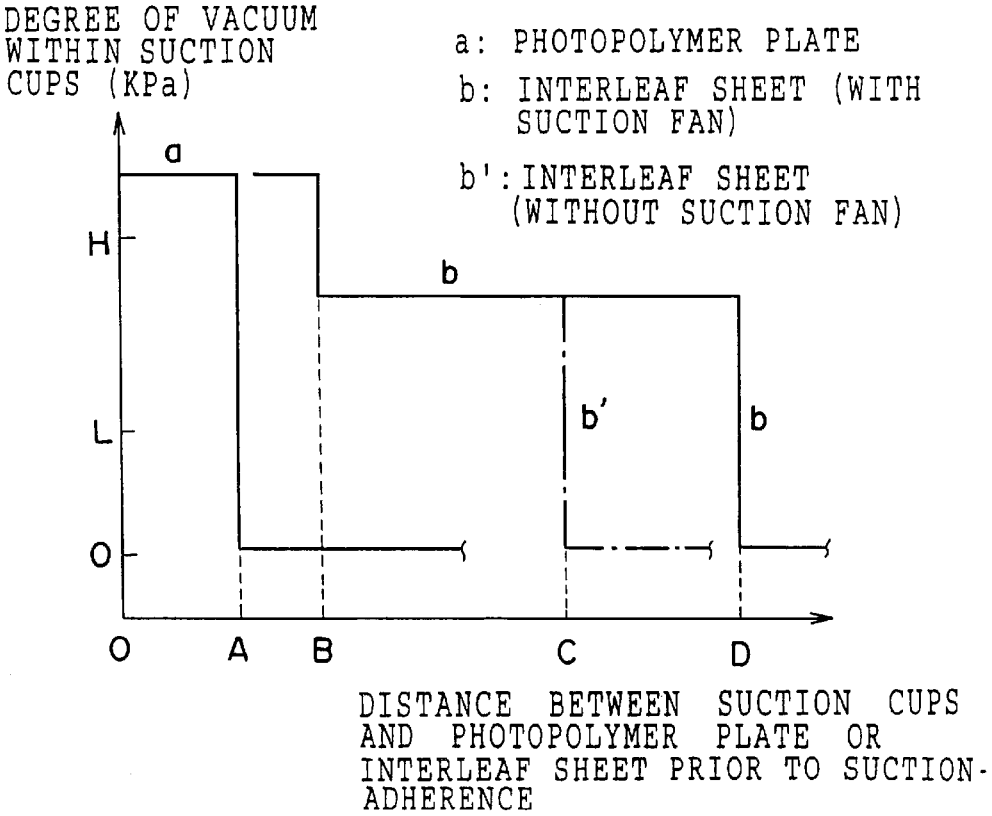
FIG. 6 is a graph which shows the relationship between the distance between the suction cup and a photopolymer plate or an interleaf sheet prior to suction adherence, and a degree of vacuum within the suction cup.

Two degrees of vacuum are set at the pressure switch 302. The pressure switch 302 outputs different signals in a case in which the degree of vacuum at the time of suction adherence by the suction cups 124 is greater than or equal to the respective set degrees of vacuum (i.e., in a case in which the absolute pressure is less than or equal to the set pressures). In other words, as illustrated in FIG. 5, in a case in which the degree of vacuum at the time of suction adherence by the suction cups 124 does not reach the lower set degree of vacuum (which is L in FIG. 5 and FIG. 6 and will be referred to as L hereinafter), a signal O illustrated in FIG. 5 is output. In a case in which the degree of vacuum at the time of suction adherence by the suction cups 124 is greater than or equal to L, a signal A illustrated in FIG. 5 is output. In a case in which the degree of vacuum at the time of suction adherence by the suction cups 124 is greater than or equal to the higher set degree of vacuum (which is H in FIG. 5 and FIG. 6 and will be referred to as H hereinafter), a signal B illustrated in FIG. 5 is output instead of the signal A. It should be noted that each of the signals O, A and B in FIG. 5 may be a combination of two or more ON/OFF signals.

Here, L and H are set in advance on the basis of the performance (or, suction capacity) of the vacuum pump 300 and the air permeability (the amount of leakage) between the suction cups 124 and the material to be suction-adhered (the photopolymer plate 102 or the interleaf sheet 118). In other words, L and H are set such that the degree of vacuum of the suction cups 124 in a case in which the suction cups 124 are not sucking anything is less than L, the degree of vacuum of the suction cups 124 in a case in which the suction cups 124 suck an interleaf sheet 118 is greater than or equal to L and lower than H, and the degree of vacuum of the suction cups 124 in a case in which the suction cups 124 suck a photopolymer plate 102 is greater than or equal to H.

Accordingly, on the basis of the output signal of the pressure switch 302, it can be determined whether or not a material is being suction-adhered by the suction cups 124 and if so, whether the sucked material is a photopolymer plate 102 or an interleaf sheet 118.

The suction cups 124 and the suction fan 126 having the structure described above can integrally approach and move away from the surfaces of the interleaf sheets 118 or the photopolymer plates 102 accommodated within the magazine 208 in a stacked state.

The plate feeding section 108 basically comprises: a common conveying section 128 which receives a photopolymer plate 102 or an interleaf sheet 118 from the sheet section 106 and conveys the photopolymer plate 102 or the interleaf sheet 118; a photopolymer plate conveying section 130 for receiving the photopolymer plate 102 and sending it to the surface plate 110; an interleaf sheet conveying section 134 which receives the interleaf sheet 118 and sends it to an interleaf sheet accommodating section 132 (which is provided at the carriage 200); and a conveyance switching section 136 which switches to guide the photopolymer plate 102 or the interleaf sheet 118 from the common conveying section 128 to either the photopolymer plate conveying section 130 or the interleaf sheet conveying section 134.

In other words, the plate feeding section 108 is structured such that the photopolymer plates 102 and the interleaf sheets 118 which are stacked alternately are discriminated on the basis of the signal that the pressure switch 302 outputs in accordance with the degree of vacuum at the suction cups 124 at the time of suction adherence. The conveyance switching section 136 is switched by a controller which is not illustrated, and the photopolymer plate 102 or the interleaf sheet 118 is conveyed in a corresponding predetermined direction.

Figure 7A:
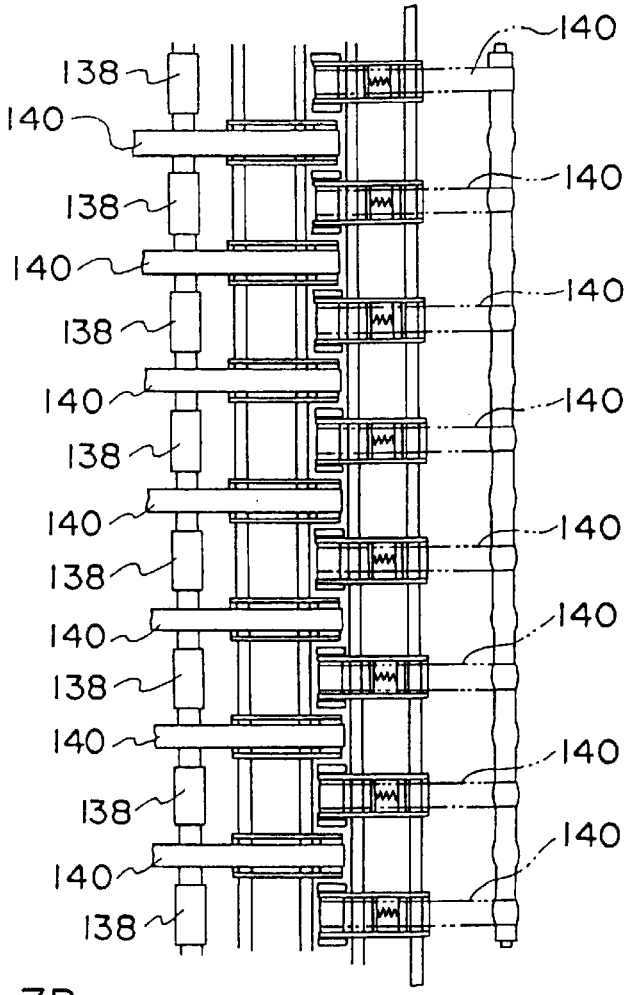
FIGS. 7A, 7B and 7C are plan views respectively showing a portion of a conveying system of the plate feeding section.
Figure 7B:
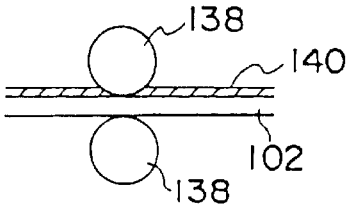

Here, as illustrated in FIG. 7A, the common conveying section 128, the photopolymer plate conveying section 130, and the conveyance switching section 136 are each a conveying system, in which skewered rollers 138 and narrow belts 140 are combined with each other and which mainly conveys the photopolymer plates 102 (see FIG. 7B). In other words, the photopolymer plates 102 are conveyed by the strong nipping force of the skewered rollers 138, and the narrow belts 140 function as guide plates which move synchronously with the conveying.

Figure 7C:
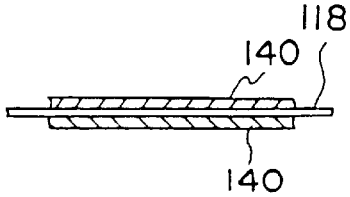

On the other hand, as illustrated in FIG. 7C, the interleaf sheet conveying section 134 is a conveying system comprised only of the narrow belts 140 and structured such that the interleaf sheet 118 is conveyed by the weak nipping force of the narrow belts 140.

Figure 8:
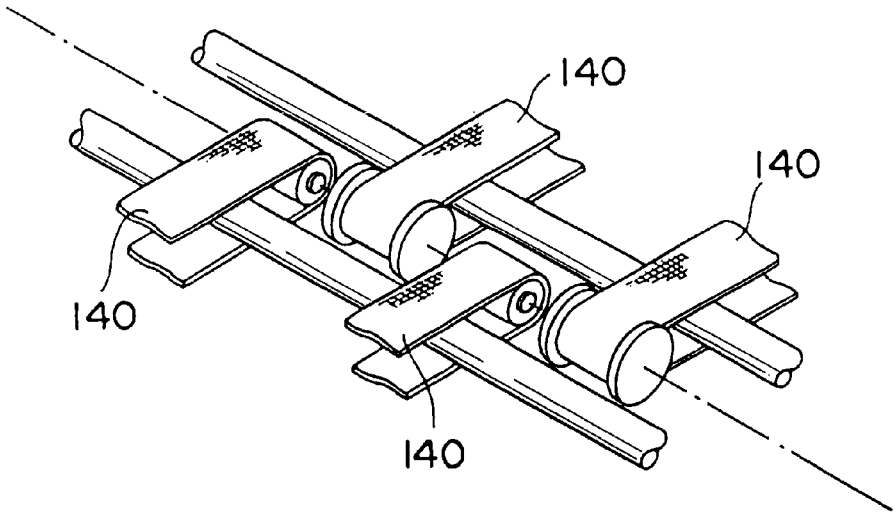
FIG. 8 is a perspective view which illustrates a transfer portion of a different conveying system of the plate feeding section.

As illustrated in FIG. 8, at the transfer portion of each conveying section, the respective distal end portions project out alternately in skewer shapes, such that the distal end of one concave portion or one convex portion opposes the distal end of a convex portion or a concave portion. (In other words, a coaxial, common conveying path is formed.) In this way, when the photopolymer plate 102 or the interleaf sheet 118 is transferred, the problem of the photopolymer plate 102 or the interleaf sheet 118 becoming wound up by the skewered rollers 138 or the narrow belts 140 can be prevented in advance.

As illustrated in FIG. 3, the interleaf sheet 118 conveyed by the interleaf sheet conveying section 134 is guided to the interleaf sheet accommodating section 132 serving as a stacking section, by means of the sheet material forcibly stacking device 141 provided at the carriage 200.

Figure 9:
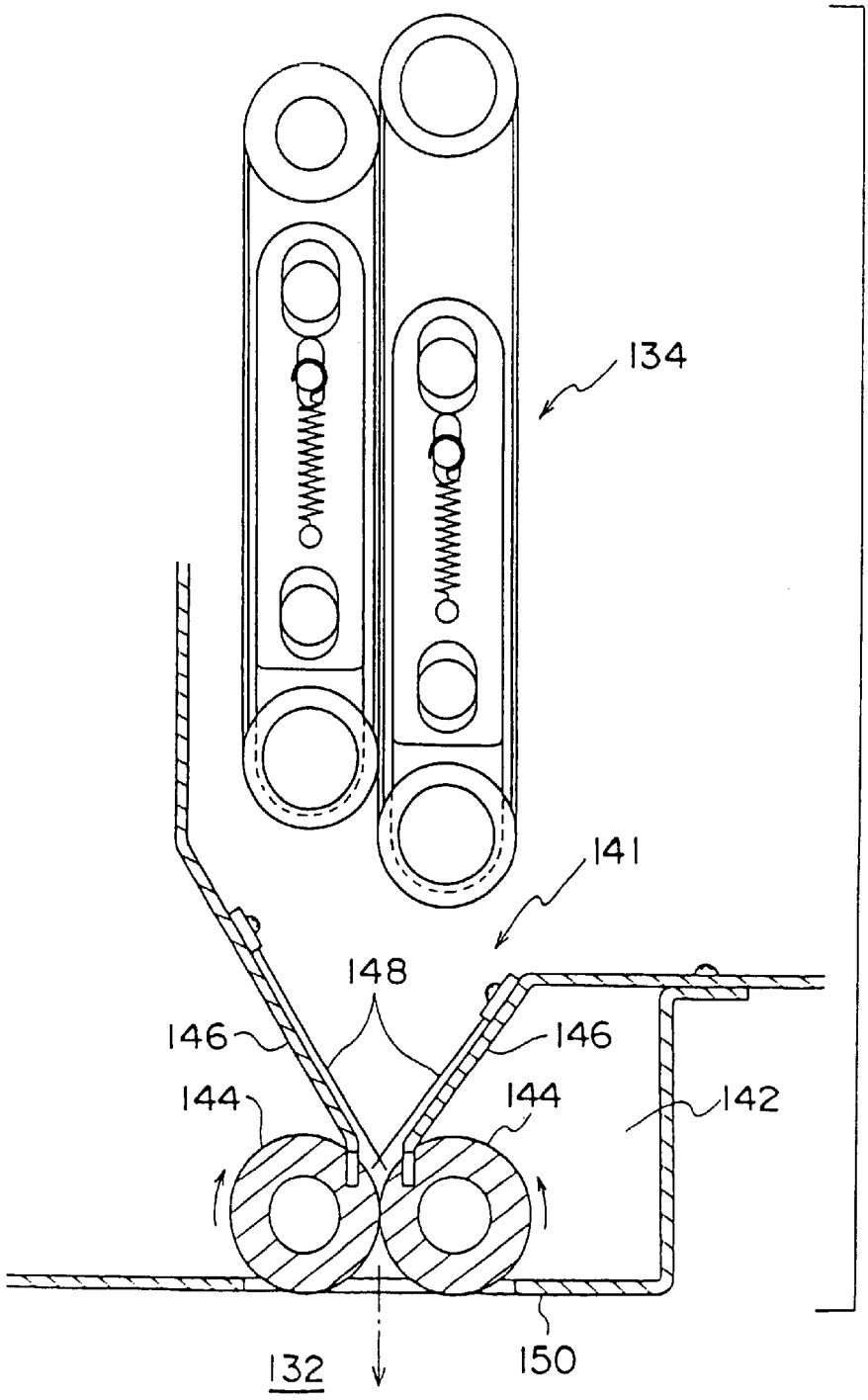
FIG. 9 is a sectional view which illustrates details of a sheet material forcibly stacking device.

The sheet material forcibly stacking device 141 is illustrated in detail in FIG. 9.

Figure 10:
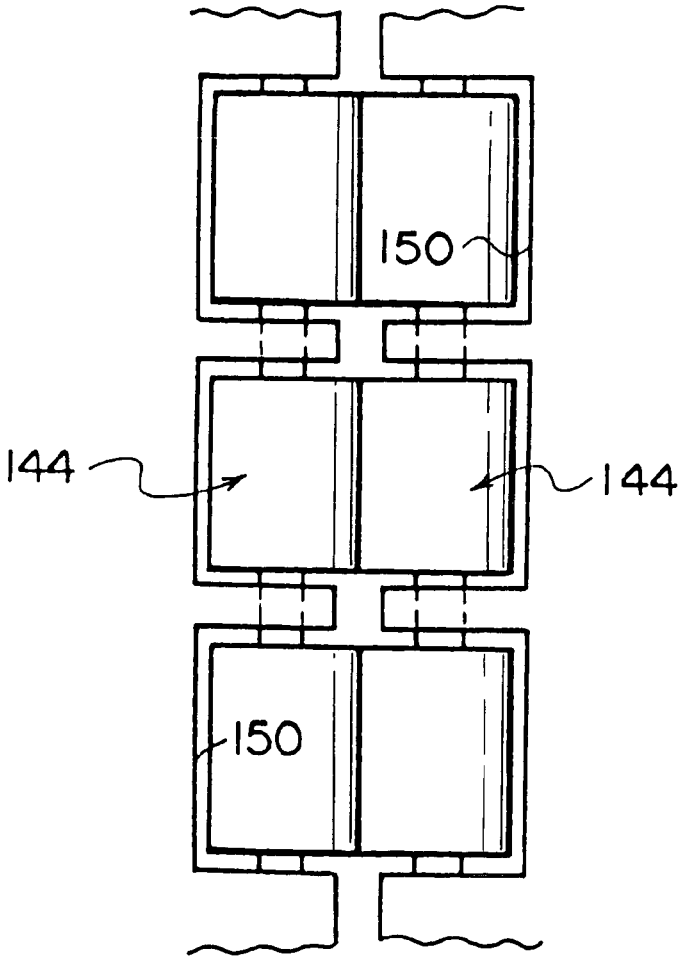
FIG. 10 is a top view which illustrates a roller and take-up preventing plate of the sheet material forcibly stacking device.

In the sheet material forcibly stacking device 141, a pair of rollers 144 serving as nipping and feeding rollers are provided at an insertion opening 142 for the interleaf sheet 118 provided at the upper portion of the interleaf sheet accommodating section 132. As illustrated in FIG. 10, the pair of rollers 144 are skewer-like and are driven to rotate at a linear velocity which is slightly (1.1 times) faster than a conveying velocity of the interleaf sheet conveying section 134. Thus, when an interleaf sheet 118 bridges over between the interleaf sheet conveying section 134 and this pair of rollers 144, the interleaf sheet 118 is conveyed while a predetermined state of tension thereof is maintained (a so-called tensile condition), and jamming of the interleaf sheet 118 due to slackness or the like can be prevented.

Further, at the side of the interleaf sheet conveying section 134 of the insertion opening 142, guide plates 146 having a tapered shape such that width thereof (which is in a direction of thickness of the interleaf sheet 118) gradually narrows are provided. Moreover, a charge eliminating brush 148 is mounted on each of these guide plates 146 which are tapered and oppose each other. The charge eliminating brushes 148 remove electric charge on the interleaf sheet 118 which is inserted into the insertion opening 142.

In the vicinity of the lower part of the pair of rollers 144, draw-in preventing plates 150 are provided along the convexities and concavities formed by the skewer form of the rollers 144. Accordingly, even if a portion of the interleaf sheet 118, which has passed through the rollers 144 and is stacked in the interleaf sheet accommodating section 132, contacts the rollers 144, it can be prevented from being drawn into the rollers 144 by means of the draw-in preventing plates 150.

On the other hand, as illustrated in FIG. 1, the photopolymer plate 102 conveyed by the photopolymer plate conveying section 130 moves away from the photopolymer plate conveying section 130 in a state of being conveyed horizontally, and is delivered to the surface plate 110.

Figure 11A:
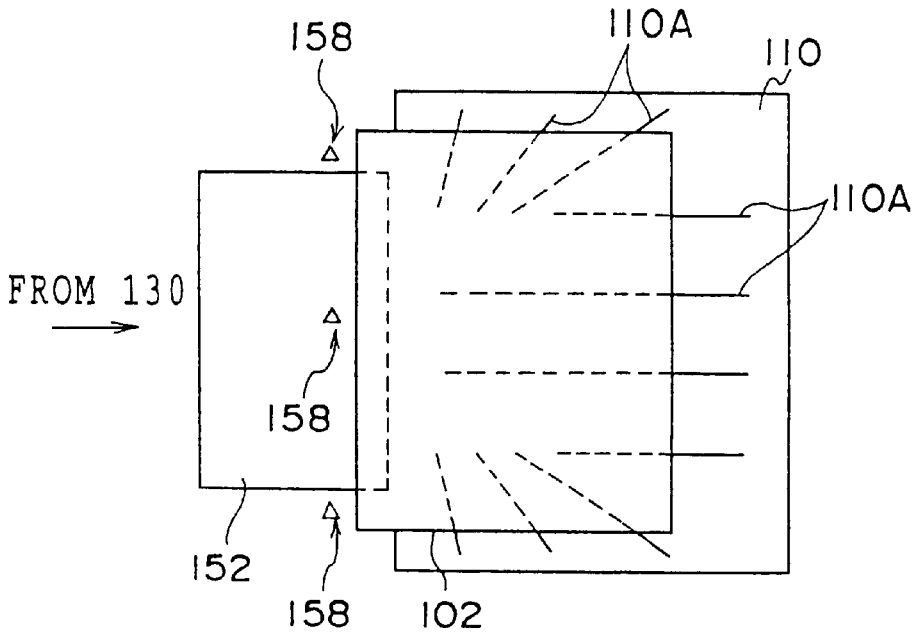
FIG. 11A is a top view of a surface plate.
Figure 11B:
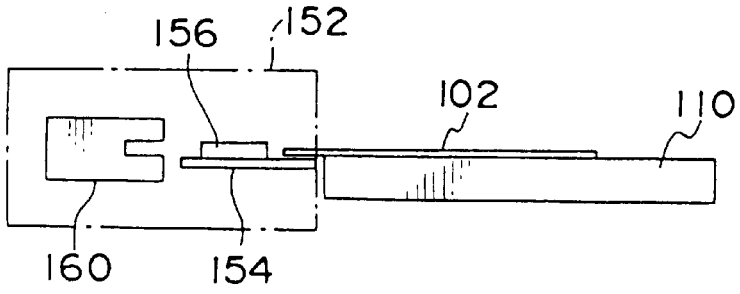
FIG. 11B is a side view of the surface plate.

Here, the height of the top surface of the surface plate 110 is positioned lower than the height of the horizontal conveying by means of the photopolymer plate conveying section 130, and the surface plate 110 is disposed such that there is a slight gap between the surface plate 110 and the photopolymer plate conveying section 130 in the conveying direction of the photopolymer plates 102. Therefore, when a photopolymer plate 102 is discharged from the photopolymer plate conveying section 130, it lands on the surface plate 110 in a state in which it slightly hangs down and the conveying direction trailing end portion of the photopolymer plates 102 is disposed in a position further toward the photopolymer plate conveying section 130 side than the surface plate 110. As illustrated in FIG. 11, at the photopolymer plate conveying section 130 side of the surface plate 110, a pair of temporarily supporting arms 154, which are provided at an discharge mechanism section 166 which will be described later, are disposed to prevent the photopolymer plate 102 from hanging down.

Further, a movable body 152 which is capable of approaching and moving away from the surface plate 110 is provided in a vicinity of the pair of temporarily supporting arms 154. A pusher plate 156 which pushes the trailing end portion of the photopolymer plate 102 in the conveying direction is provided at this movable body 152. By the pusher plate 156 pushing the trailing end portion of the photopolymer plate 102, the photopolymer plate 102 can be sent to a predetermined conveying direction reference position, without being conveyed at an angle with respect to the conveying direction. This reference position is a state in which the conveying direction trailing end portion of the photopolymer plate 102 slighly protrudes from the surface plate 110.

At this reference position, sensors 158 are provided at a plurality of positions including both corners of the conveying direction trailing end portion of the photopolymer plate 102. Due to the sensors 158 detecting the conveying direction trailing end portion of the photopolymer plate 102, the pushing of the trailing end portion of the photopolymer plates 102 by the pusher plate 156 is stopped. Also, these sensors 158 are applied to the detection of the transverse direction position of the photopolymer plate 102. In other words, by moving the surface plate 110 in the transverse direction, the corners of the photopolymer plate 102 and the positions of the sensors 158 are matched. The position where the corners of the photopolymer plate 102 and the positions of the sensors 158 match is recorded as an initial position of the photopolymer plate 102.

A relative position between the position of the photopolymer plate 102 which has been moved to the initial position and the scanning exposure start position at the exposure section 112 which will be described later is determined, and in this state, suction and holding by suction grooves 110A provided at the surface plate 110 is carried out.

Punch holes are formed by a puncher 160 provided at the moving body 152, in the photopolymer plate 102 which is sucked and held.

Moreover, the surface plate 110 can move reciprocally (in a direction which is in common with the movement transverse to the conveying direction for positioning the photopolymer plate 102) at an uniform velocity between a first position (the solid line position in FIG. 1) for receiving the photopolymer plate 102 from the photopolymer plate conveying section 130 and a second position (the imaginary line position in FIG. 1) for accommodating the photopolymer plate 102 in the exposure section 112.

At the exposure section 112, a scanning unit 164 is provided above the conveying path of the surface plate 110, and is structured such that laser beams whose lighting is controlled in accordance with image signals are main-scanned (in a direction orthogonal to the conveying direction of the surface plate 110). The conveying of the surface plate 110 in one direction is sub-scanning movement, and as a result thereof, an image is recorded on the photopolymer plate 102 placed on the surface plate 110 at the time of the conveying in the one direction toward the exposure section 112. The surface plate 110 is returned to its original position by conveying thereof in the reverse direction. Further, the suction holding of the photopolymer plate 102 on the surface plate 110 which has returned to its original position is cancelled.

The discharge mechanism section 166 is provided at the conveying direction rear end portion side of the photopolymer plate 102 conveyed by the photopolymer plate conveying section 130. The discharge mechanism section 166 is provided so as to correspond to the surface plate 110 on which an image has been recorded and which has returned to its original position.

FIG. 12 schematically illustrates the structure of the discharge mechanism section 166. At the discharge mechanism section 166, each of the pair of temporarily supporting arms 154 is rotatably supported via a supporting shaft 170 at a state base 168 such that the distal end portion of the temporarily supporting arm 154 is positioned in a vicinity of the surface plate 110. A convex portion 172, a concave portion 174, and a convex portion 176, each of which has a different heightwise (depthwise) dimension, are formed at the lower surface side of the temporarily supporting arm 154.

The moving state 178 is disposed beneath the temporarily supporting arms 154. The moving stage 178 is movable along the temporarily supporting arms 154, and a roller 180 is provided at the distal end portion thereof. The roller 180 abuts the lower surfaces of the temporarily supporting arms 154. Accordingly, by moving the moving stage 178, the abutting supporting position of the roller 180 (the convex position 172, the concave portion 174, and the convex portion 176) changes, and the heightwise positions of the distal end portions of the temporarily supporting arms 154 are thereby changed. A spring 182 is attached to the rear end portion of the temporarily supporting arms 154. The temporarily supporting arm 154 always follows the movement of the moving stage 178.

Figure 12A:
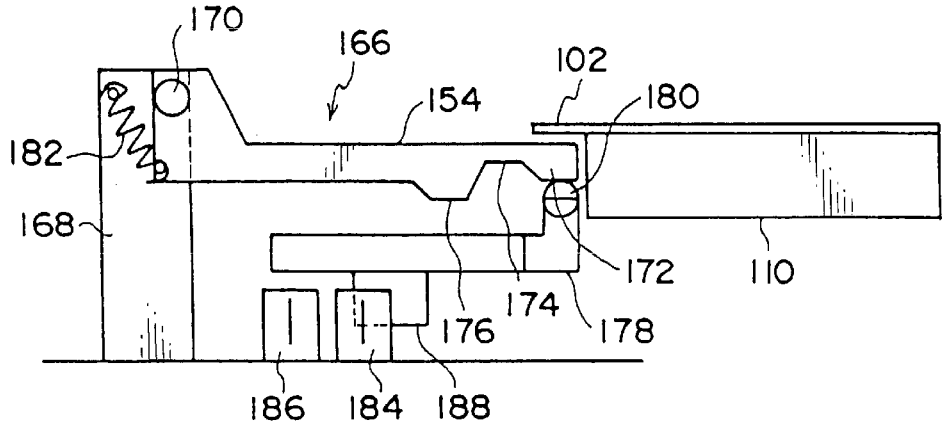
Figure 12B:
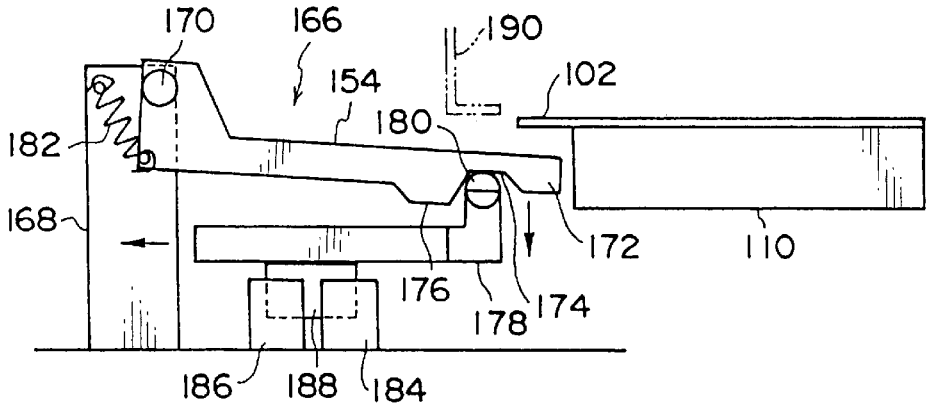
Figure 12C:
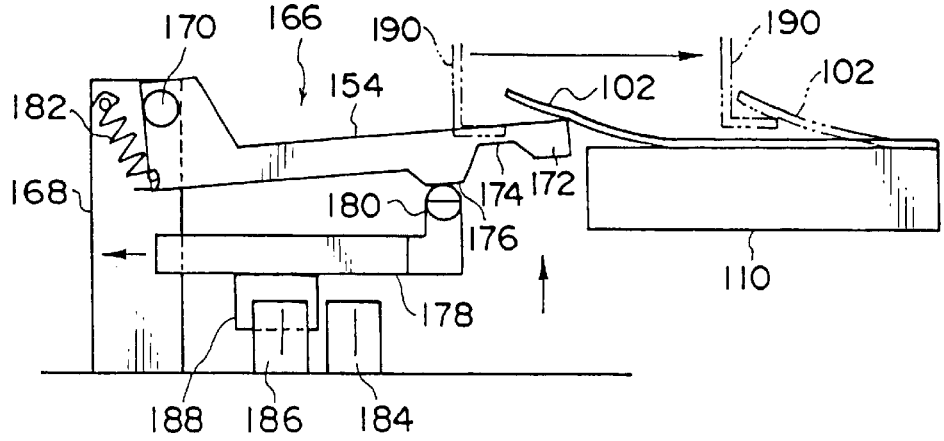

The dimensions of the respective portions are set such that the following states arise. In the state in which the roller 180 abuts the convex portion 172 and supports the temporarily supporting arm 154, as illustrated in FIG. 12A, the temporarily supporting arm 154 is in a horizontal position at the same height as the surface plate 110. When the roller 180 is in a state of abutting the concave portion 174 and supporting the temporarily supporting arm 154, as shown in FIG. 12B, the temporarily supporting arm 154 is at a withdrawn position which is lower than the surface plate 110. In the state in which the roller 180 abuts the convex portion 176 and supports the temporarily supporting arm 154, as illustrated in FIG. 12C, the temporarily supporting arm 154 is at a pushed up position which is higher than the surface plate 110. Accordingly, due to the roller 180 of the moving stage 178 abutting the convex portion 172 of the temporarily supporting arm 154 and the temporarily supporting arm 154 being set at a horizontal position at the same height as the surface plate 110, the photopolymer plate 102 can be prevented from hanging down onto the surface plate 110. Further, due to the roller 180 of the moving stage 178 abutting the convex portion 176 of the temporarily supporting arm 154 and the temporarily supporting arm 154 being set at a pushed up position which is higher than the surface plate 110, the rear end portion of the photopolymer plate 102 on the surface plate 110 can be raised up.

A pair of sensors 184, 186 are disposed beneath the moving stage 178. Due to the sensors 184, 186 detecting a dog 188 provided at the moving stage 178, the position of the moving stage 178, i.e., the position of the temporarily supporting arm 154 can be detected. Namely, in the state in which only the sensor 184 detects the dog 188, the temporarily supporting arm 154 is set at the horizontal position at the same height as the surface plate 110. In the state in which both of the sensors 184, 186 detect the dog 188, the temporarily supporting arm 154 is set at the withdrawn position lower than the surface plate 110. In the state in which only the sensor 186 detects the dog 188, the temporarily supporting arm 154 is set at the pushed-up position higher than the surface plate 110.

Figure 13:
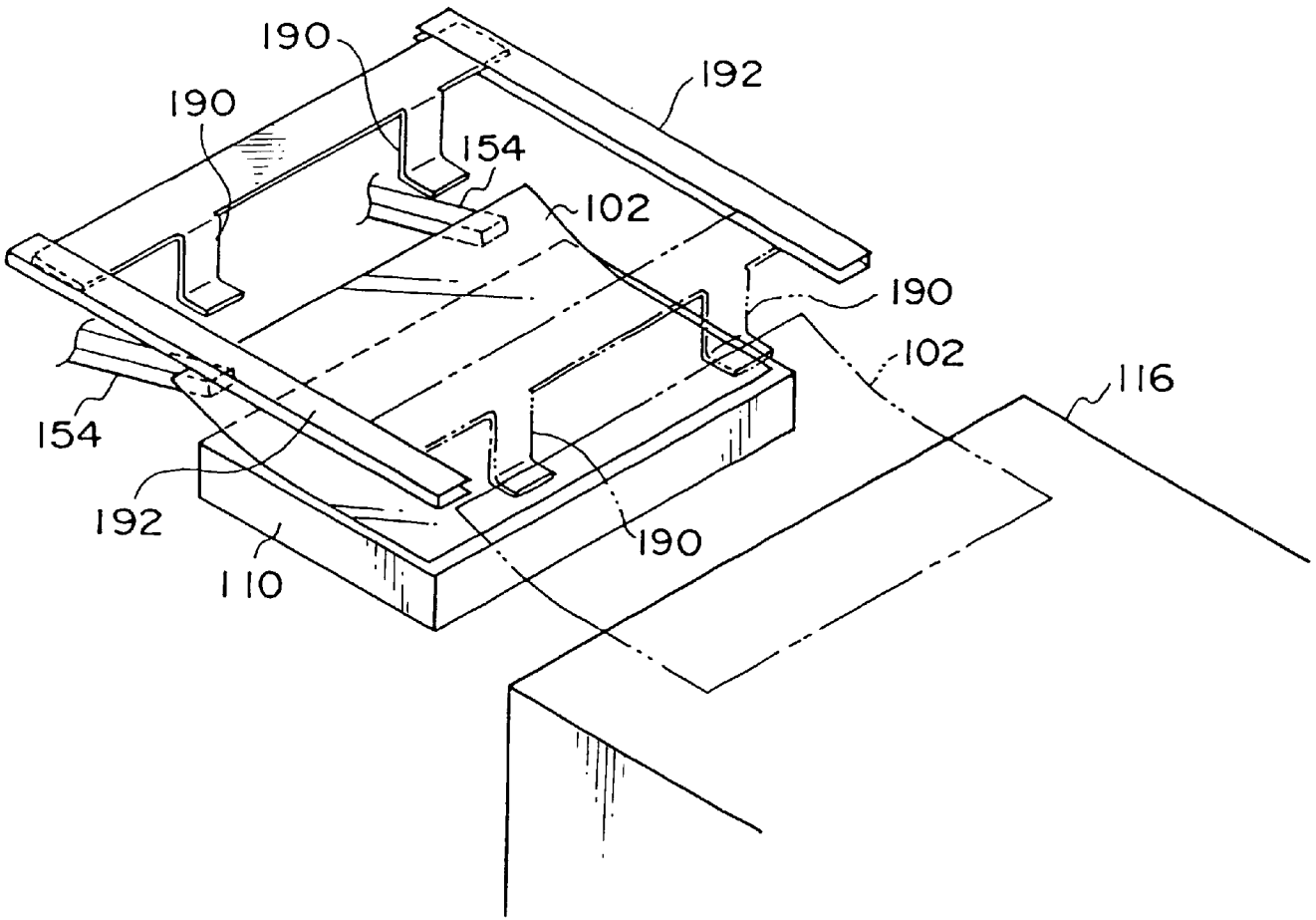
FIG. 13 is a perspective view which illustrates plate discharging fingers of the discharge mechanism section.

On the other hand, a pair of plate-discharging fingers 190 are provided above the temporarily supporting arms 154 at the discharge mechanism section 166. As illustrated in FIG. 13, the pair of plate-discharging fingers 190 are movable along guide rails 192 which are disposed along the surface plate 110. Namely, the plate-discharging fingers 190 pass above the surface plate 110 and move to the conveying direction leading end portion of the photopolymer plate 102.

In the state in which the trailing end portion of the photopolymer plate 102 jutting out from the surface plate 110 is raised up by the temporarily supporting arms 154, due to the plate-discharging fingers 190 moving in the conveying direction of the photopolymer plate 102, the plate-discharging fingers 190 catch on the photopolymer plate 102. Accordingly, the photopolymer plate 102 on which the plate-discharging fingers 190 are caught is conveyed to the downstream side of the surface plate 110 in accordance with the movement of the plate-discharging fingers 190.

At the downstream side of the surface plate 110, a buffer section 114 is provided and an automatic developing device 116 is also provided. Therefore, the photopolymer plate 102 is sent out smoothly, while the difference between the discharging velocity of the discharge mechanism section 166 and the conveying velocity of the automatic developing device 116 is absorbed by the buffer section 114.

Detailed Structure of Carriage 200

Figure 14:
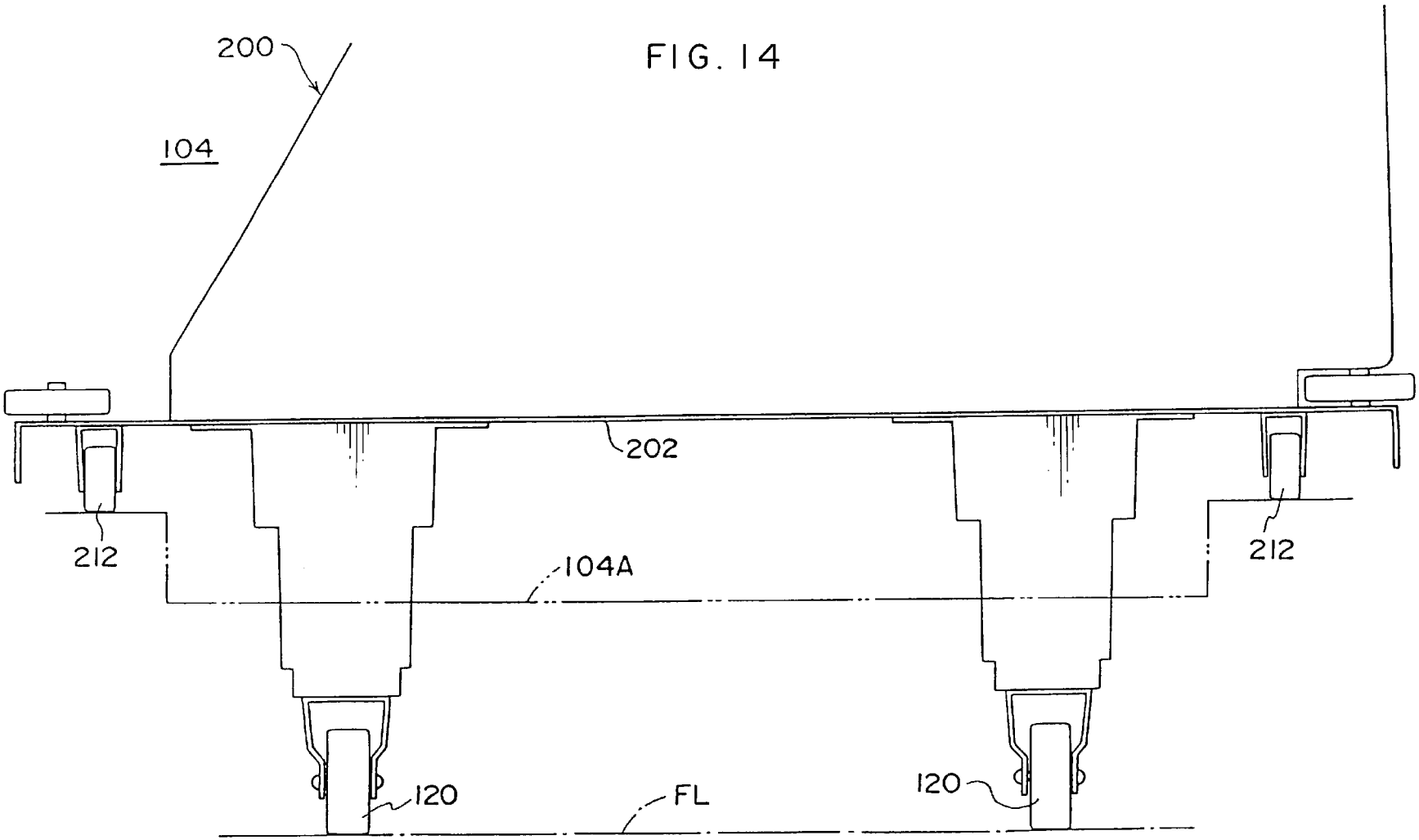
FIG. 14 is an enlarged side view of a lower portion of a carriage.

The carriage 200 is illustrated in FIG. 1 and FIG. 14. In the carriage 200, a handle 204 (see FIG. 1) is mounted to a loading stand 202 which is supported on the floor surface FL via four casters 120 (only two of which are illustrated in FIG. 14). One end portion of the handle 204 is bent in a substantial U-shape, and the both ends thereof abut and are fixed to the loading stand 202.

At the loading stand 202, an stacking section 206 which holds the photopolymer plates 102 in a stacked state is provided. Viewed from the side, this stacking section 206 is substantially in the shape of a right triangle, and the magazine 208 which accommodates the photopolymer plates 102 leans on the inclined surface of the stacking section 206.

A plurality of photopolymer plates 102 are stacked in advance in the magazine 208. Moreover, a shutter 210 is provided at the magazine 208. By keeping the shutter 210 closed at times other than when the carriage 200 is in a darkroom, the photopolymer plates 102 can be prevented from being sensitized.

In other words, the carriage 200 is conveyed between the plate accommodating section 104 and a darkroom where the photopolymer plates 102 are stored, and the shutter 210 can protect the photopolymer plates 102 during conveying.

The side of the carriage 200 to which the handle 204 is attached faces backwards at a time of conveyance. The handle 204 is accommodated at the plate accommodating section 104.

Here, as illustrated in FIG. 14, the plate accommodating section 104 is a box-shaped space having the floor portion 104A positioned higher than the floor surface FL, and the carriage 200 is accommodated so as to be supported on this floor portion 104A. At this time, the casters 120 of the carriage 200 are folded up, and the carriage 200 is supported by a plurality (six in the present embodiment) of auxiliary rollers 212 mounted to the bottom surface of the loading stand 202.

Figure 15:
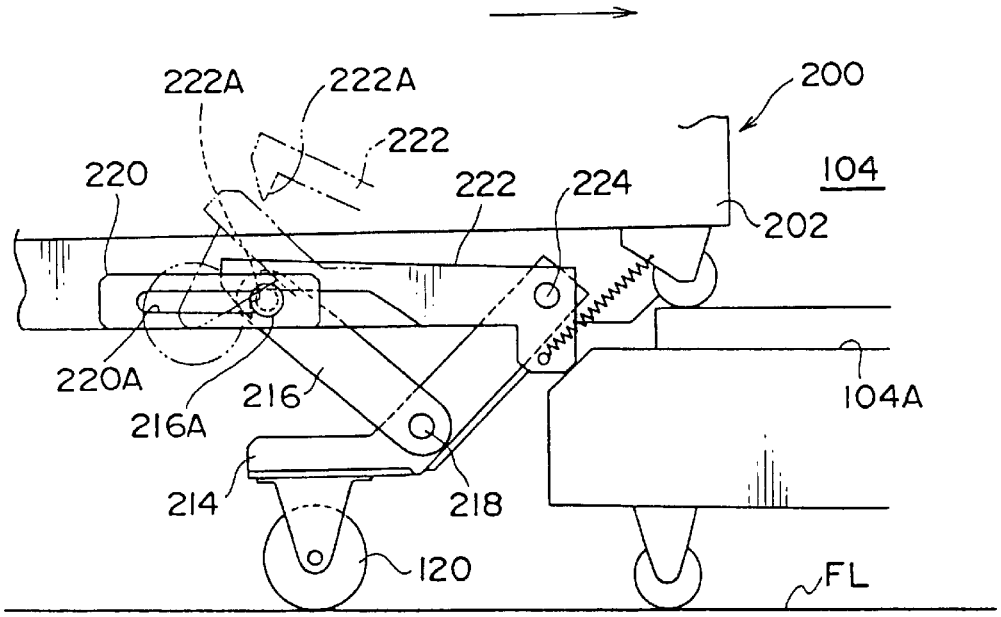
FIG. 15 is a side view which illustrates a structure of a caster receiving mechanism section.

Folding up of the casters 120 is performed at the time that the carriage 200 is to be accommodated in the plate accommodating section 104. As illustrated in FIG. 15, each caster 120 is mounted to one end portion of a main arm 214. The other end portion of the main arm 214 is rotatably supported at an L-shaped arm 222. One end portion of a support arm 216 is rotatably mounted through a shaft 218 to the longitudinal direction intermediate portion of the main arm 214. A slide pin 216A is mounted to the other end portion of the support arm 216 and accommodated in an elongated hole 220A of a fixed rail arm 220.

In a normal state (in the state in which the casters 120 are fixed), a hook portion 222A formed at one end portion of the L-shaped arm 222 engages with the slide pin 216A, and the slide pin 216A is retained in the vicinity of one end portion of the elongated hole 220A.

The bent portion of the L-shaped arm 222 is supported via a rotatable shaft 224 of the main arm 214. The other end portion of the L-shaped arm 222 is disposed at a position at which it abuts the end surface of the floor portion 104A in the plate accommodating section 104.

Here, when the other end portion of the L-shaped arm 222 is pressed further in a state in which it abuts the end surface of the floor portion 104A, the L-shaped arm 222 rotates around the shaft 224 and the hook portion 222A separates from the slide pin 216A.

Due to this separating of the hook portion 222A, the support arm 216 to which the slide pin 216A is mounted is moved to the other end portion of the elongated hole 220A due to the urging force of an urging device. Therefore, the main arm 214 is raised in accordance with this movement, and the caster 120 separates from the floor surface. Further, the carriage 200 is supported at the floor portion FL through the auxiliary rollers 212 at this time.

Hereinafter, operation of the present embodiment will be described.

In a case in which the photopolymer plates 102 are accommodated in the plate accommodating section 104 of the automatic exposure device 100, the photopolymer plates 102 can be positioned at a predetermined position by accommodating them together with the carriage 200.

When loading of the magazine 208 is completed, the carriage 200 is conveyed once again to the automatic exposure device 100, an opening and closing lid (which opens and closes orthogonally to the paper surface of the illustration in FIG. 3) is opened, and the carriage 200 is accommodated in the plate accommodating section 104.

Although the floor portion 104A in the plate accommodating section 104 is positioned higher than the floor surface FL at this time, in the present embodiment, the caster 120 folding structure is utilized, and the carriage 200 can be accommodated on the floor portion 104A in the plate accommodating section 104 without changing the height position of the carriage 200. In other words, by transferring the support of the carriage 200 from the casters 120 to the auxiliary rollers 212, the carriage 200 can be transferred smoothly from the floor surface FL to the floor portion 104A between which there is a step. As a result, the plate accommodating section 104 can be made to be a rigid structure surrounded by a frame body (a so-called closed cross-sectional structure), and a lid body having excellent shading property can be used.

After accommodating the carriage 200 in the plate accommodating section 104, in the sheet section 106, the photopolymer plates 102 and the interleaf sheets 118 are taken out from their alternately stacked state by means of the suction adherence conveying device 109 (the suction cups 124 and the suction fan 126), and are sent to the plate feeding section 108. The photopolymer plate 102 or the interleaf sheet 118 sent to the plate feeding section 108 is discriminated on the basis of the signal output by the pressure switch 302 in response to the degree of vacuum at the time of suction adherence, the conveyance switching section 136 is switched by the controller which is not illustrated, and the photopolymer plate 102 or the interleaf sheet 118 is conveyed in the corresponding predetermined directions.

In other words, the photopolymer plate 102 sent to the plate feeding section 108 is conveyed by the common conveying section 128 and the photopolymer plate conveying section 130, fed onto the surface plate 110, and discharged after a predetermined image is exposed thereon.

On the other hand, the interleaf sheet 118 is conveyed by the common conveying section 128 and the interleaf sheet conveying section 134, and stacked in the interleaf sheet accommodating section 132 by the sheet material forcibly stacking device 141 provided at the carriage 200.

Here, when the suction cups 124 and the suction fan 126 remove the interleaf sheet 118 or the photopolymer plate 102 accommodated within the magazine 208 in a stacked state, the suction cups 124 and the suction fan 126 are disposed at positions (between C and D in FIG. 6) slightly spaced apart from the photopolymer plate 102 or the interleaf sheet 118. Only the suction fan 126 is activated, the vacuum pump 300 which is in communication with the suction cups 124 is activated after a predetermined time, and the suction fan 126 is stopped.

In a case in which the suction fan 126 sucks up an interleaf sheet 118 which is lightweight and thin, the pressure switch 302 outputs signal A illustrated in FIG. 5 without being affected by the photopolymer plate 102 (between A and B in FIG. 6) layered under the interleaf sheet 118. It is therefore surely determined that an interleaf sheet 118 is being suction-adhered. Also, since the interleaf sheet 118 is sucked in a state in which it has been separated from the photopolymer plate 102, the sucking of two layers (i.e., sucking the photopolymer plate 102 layered under the interleaf sheet 118 together with the interleaf sheet 118) is prevented. Furthermore, due to use of the suction fan 126, the distance between the suction cups 124 and the interleaf sheet 118 can be set to be as large as the distance between B and C illustrated in FIG. 6. Therefore, even in a case in which the photopolymer plate 102 has curled, the distance between the suction cups 124 and the interleaf sheet 118 cannot be shorter than the distance between O and B illustrated in FIG. 6, and incorrect determination and the suctioning of two layers can be prevented.

Further, in a case in which the structure does not include the suction fan 126, by activating the vacuum pump 300 at a position (between B and C in FIG. 6) where the suction cups 124 are somewhat spaced apart from the photopolymer plate 102 or the interleaf sheet 118, incorrect determination and the sucking up of two layers can be prevented.

On the other hand, in a case in which the pressure switch 302 outputs the signal O illustrated in FIG. 5, the suction cups 124 approach the stacked layers up to a position (between O and A illustrated in FIG. 6) where the photopolymer plate 102 can be sucked by the suction cups 124. At this time, in a case in which the pressure switch 302 outputs the signal B illustrated in FIG. 5, it is determined that the suction cups 124 have suction-adhered a photopolymer plate 102. In a case in which the pressure switch 302 outputs the signal O illustrated in FIG. 5, it is determined that the magazine 208 is empty.

As described above, in the suction adherence conveying device 109 relating to the present embodiment, a reduction in costs can be achieved by using the inexpensive pressure switch 302 which is necessary to distinguish between the photopolymer plates 102 and the interleaf sheets 118 accommodated in the magazine 208. Further, there is no fear that the photopolymer plates 102 are sensitized at this time of determination. Furthermore, an improvement in the determination accuracy and prevention of the sucking of two layers are achieved.

The above embodiment utilizes the suction adherence conveying device 109 for printing plates which uses a single pressure switch 302 in which two degrees of vacuum are set and which outputs respectively different signals in cases in which the degree of vacuum at the time of suction adherence by the suction cups 124 is greater than or equal to the respective set degrees of vacuum (i.e., a case in which the absolute pressure is less than or equal to the set pressure). However, it should be noted that the present invention is not limited to the same and can also be applied to a suction adherence conveying device for printing plates which uses a plurality of pressure switches which have respectively different set degrees of vacuum and which each output a signal in a case in which the degree of vacuum at the time of suction adherence by the suction cups 124 is equal to or higher than the degree of vacuum which has been set thereat. Further, the present invention can also be applied to a structure using a pressure sensor which outputs a linear signal with respect to the degree of vacuum, instead of using the pressure switch.

In addition, although the suction fan 126 is used for preventing incorrect determination and the suction adherence of two layers in the embodiment described above, the present invention can utilize a blower which can obtain an effect which is similar to the case in which the suction fan 126 is used, by blowing out air from a direction substantially perpendicular to the sucking direction by the suction cups 124 to allow the interleaf sheet 118 to float up in a case in which the interleaf sheet 118 is the uppermost layer of the alternately stacked photopolymer plates 102 and interleaf sheets 118.

What is claimed is:

1. A suction adherence conveying device for printing plates comprising:

suction cups which are provided so as to be able to approach and move away from a surface of a printing plate or an interleaf sheet accommodated in a magazine;

a suction section which communicates with the suction cups through communicating paths and sucks in air from the suction cups, and due to the suction section sucking in air from the suction cups, the printing plate or the interleaf sheet is vacuum-suction-adhered and removed from the magazine in this state one at a time; and a pressure sensor which is set in communication with the communication paths, and detects that a degree of vacuum at the time of suction-adhesion by the suction cups is greater than or equal to a first degree of vacuum set to correspond to a case in which the interleaf sheet is suction-adhered, and detects that the degree of vacuum at the time of suction-adhesion by the suction cups is greater than or equal to a second degree of vacuum which is set to correspond to a case in which the printing plate is suction-adhered and which is higher than the first degree of vacuum.

2. A suction adherence conveying device for printing plates according to claim 1, further comprising a suction fan which, along with the suction cups, approaches and moves away from the surface of the printing plate or the interleaf sheet accommodated within the magazine, and which has a suction capacity which is capable of suction-adhering the interleaf sheet and incapable of suction-adhering the printing plate from a position spaced a predetermined distance apart therefrom.

3. A suction adherence conveying device for printing plates according to claim 2, further comprising a conveying de vice having a conveyance switching section in which a conveying path for the interleaf sheet or the printing plate is selectively controlled in accordance with results of detection of the pressure sensor.

4. A suction adherence conveying device for printing plates according to claim 1, wherein the suction section is a vacuum pump.

5. A suction adherence conveying device for printing plates according to claim 1, further comprising a blower which blows out air from a direction substantially perpendicular to a sucking direction of the suction cups, so as to lift the interleaf sheet.

6. A suction adherence conveying device for printing plates according to claim 1, wherein the first and second degrees of vacuum are set in accordance with the capacity of the suction section and air permeability between the suction cups and the interleaf sheet or the printing plate.

7. A conveying device using suction adherence for separating different types of sheets of materials from one another, the conveying device comprising:

(a) a magazine adapted for receiving different types of sheets of materials interleaved with another in a stack in the magazine;

(b) a support structure to which the magazine removably mounts;

(c) a plurality of suction cups movably mounted to the support structure, the suction cups being movable in a direction towards and away from a stack of sheet materials in the magazine;

(d) a vacuum system connected through fluid communication paths to the suction cups, and a reduced pressure communicated to the suction cups through the communication paths when the vacuum system is operated and generating a suction at the suction cups, which suction adheres a sheet of material from the stack when the suction cups are moved proximate the stack; and (e) a pressure sensor in communication with the fluid communication paths, the sensor when operated, producing a signal corresponding to a degree of vacuum in the fluid communication paths for indicating whether a sheet material has adhered to the suction cups, and type of sheet material.

8. The conveying device of claim 7, further comprising at least one suction fan movably mounted to the support structure, the suction fan being movable in a direction towards and away from a stack of sheet materials in the magazine.

9. The conveying device of claim 7, wherein the vacuum system includes a vacuum pump.

10. The conveying device of claim 7, further comprising a blower disposed to direct an airflow when operated, substantially orthogonal to a direction in which sheets of material are suction adhered to the suction cups, the airflow being sufficient for lifting one of the types of sheet material.

11. The conveying device of claim 7, wherein the signal indicates one type of sheet material suction adhered to the suction cups if the signal corresponds to at least a first degree of vacuum, and another type of sheet material if the signal corresponds to at least a second degree of vacuum, with the degrees of vacuum predefined in accordance with suction capacity of the vacuum system and air permeability between the suction cups and type of sheet material adhered to the suction cups.

12. The conveying device of claim 7, further comprising a conveyor disposed for receiving a sheet of material from the suction cups, the conveyor including a switching system which directs a sheet of material received by the conveyor along different conveyance paths, the switching system receiving the signal from the pressure sensor and directing the sheet of material along a selected conveyance path based on the signal.

13. A conveying device using suction adherence for separating different types of sheets of materials from one another, the conveying device comprising:

(a) a magazine adapted for receiving different types of sheets of materials interleaved with another in a stack in the magazine;

(b) a support structure to which the magazine removably mounts;

(c) a suction system having a plurality of suction cups with tubes connecting the suction cups in fluid communication with one another, the suction cups being movably mounted to the support structure in a direction towards and away from a stack of sheet materials in the magazine;

(d) a suction assisting section provided adjacent the suction cups, which is connected in fluid communication with the suction cups through the tubes; and (e) a pressure switch activated in response to a degree of vacuum at least equal to first and second levels, the first level indicating one type of sheet material has been suction adhered to the suction cups, and the second level indicating another type of sheet material has been suction adhered to the suction cups, the pressure switch outputting a signal when activated in accordance with the level of the degree of vacuum.

14. The conveying device of claim 13, wherein the suction system includes a vacuum pump, which when operated, communicates a reduced pressure through the tubes to the suction cups.

15. The conveying device of claim 14, further comprising a conveyor disposed for receiving a sheet of material from the vacuum pump, the conveyor including a switching system which directs a sheet of material received by the conveyor along different conveyance paths, the switching system receiving the signal from the pressure switch and directing the sheet of material along a selected conveyance path based on the signal.

16. The conveying device of claim 13, wherein the suction assisting section includes a blower, which when operated, directs an airflow substantially orthogonal to a direction in which sheets of material are suction adhered to the suction caps, the airflow being sufficient for lifting one of the types of sheet material.

17. The conveying device of claim 13, wherein the suction assisting section includes at least one suction fan, which moves in correspondence with the suction cups.

18. The conveying device of claim 13, wherein the levels of the degree of vacuum are predefined in accordance with suction capacity and air permeability between the suction cups and type of sheet material adhered to the suction cups.

19. A conveying device using suction adherence for separating different types of sheets of materials from one another, the device comprising:

(a) a magazine adapted for receiving different types of sheets of materials interleaved with another in a stack in the magazine;

(b) a support structure to which the magazine removably mounts;

(c) a plurality of suction cups movably mounted to the support structure, the suction cups being movable in a direction towards and away from a stack of sheet materials in the magazine;

(d) a vacuum pump connected through fluid communication paths to the suction cups, and a reduced pressure communicated to the suction cups through the communication paths when the vacuum pump is operated and generating a suction at the suction cups, which suction adheres a sheet of material from the stack when the suction cups are moved proximate the stack; and (e) a pressure switch activated in response to a degree of vacuum at least equal to first and second levels, the first level indicating one type of sheet material has been suction adhered to the suction cups, and the second level indicating another type of sheet material has been suction adhered to the suction cups, the pressure switch outputting a signal when activated in accordance with the level of the degree of vacuum.

20. The conveying device of claim 19, wherein the pressure switch outputs a first signal corresponding to a degree of vacuum less than the first level, a second signal corresponding to a degree of vacuum at least equal to the first level and less than the second level, and a third signal corresponding to a degree of vacuum at least equal to the second level.

21. The conveying device of claim 19, wherein the suction assisting section includes a blower, which when operated, directs an airflow substantially orthogonal to a direction in which sheets of material are suction adhered to the suction cups, the airflow being sufficient for lifting one of the types of sheet material.

22. The conveying device of claim 19, wherein the suction assisting section includes at least one suction fan, which moves in correspondence with the suction cups.

23. The device of claim 19, wherein the levels of the degree of vacuum are predefined in accordance with suction capacity of the vacuum pump and air permeability between the suction cups and type of sheet material adhered to the suction cups.

24. The conveying device of claim 19, further comprising a conveyor disposed for receiving a sheet of material from the suction cups, the conveyor including a switching system which directs a sheet of material received by the conveyor along different conveyance paths, the switching system receiving the signal from the pressure switch and directing the sheet of material along a selected conveyance path based on the signal.

* * * * *